US008308055B2

(12) United States Patent
Wallmann

(10) Patent No.: US 8,308,055 B2
(45) Date of Patent: Nov. 13, 2012

(54) CONTAINER FOR ACCOMMODATING COINS AND/OR VALUABLE DOCUMENTS

(75) Inventor: Rupert Wallmann, Krispl (AT)

(73) Assignee: Giesecke & Devrient GmbH, Munich (DE)

( * ) Notice: Subject to any disclaimer, the term of this patent is extended or adjusted under 35 U.S.C. 154(b) by 0 days.

(21) Appl. No.: 12/746,259

(22) PCT Filed: Dec. 4, 2008

(86) PCT No.: PCT/EP2008/010309

§ 371 (c)(1),
(2), (4) Date: Jun. 4, 2010

(87) PCT Pub. No.: WO2009/071304

PCT Pub. Date: Jun. 11, 2009

(65) Prior Publication Data

US 2010/0258617 A1 Oct. 14, 2010

(30) Foreign Application Priority Data

Dec. 6, 2007 (DE) ..... 10 2007 058 658

(51) Int. Cl.
*G07B 15/00* (2006.01)

(52) U.S. Cl. ..... 232/15; 232/16; 232/1 D; 194/351

(58) Field of Classification Search ..... 232/1 D, 232/15, 16, 44, 55, 43.2, 4 R; 194/350, 351, 194/202; 206/0.8–0.84
See application file for complete search history.

(56) References Cited

U.S. PATENT DOCUMENTS

| | | | | | |
|---|---|---|---|---|---|
| 1,832,720 | A | * | 11/1931 | McDowell | 232/15 |
| 1,964,528 | A | * | 6/1934 | Mills | 232/15 |
| 1,984,307 | A | * | 12/1934 | Keller | 425/422 |
| 2,009,085 | A | * | 7/1935 | Jackson | 232/15 |
| 2,052,322 | A | * | 8/1936 | Terry | 232/15 |
| 2,096,476 | A | * | 10/1937 | Veale | 232/15 |
| 2,371,114 | A | * | 3/1945 | Von Stoeser | 232/15 |
| 2,604,259 | A | * | 7/1952 | Beebe | 232/15 |
| 3,741,464 | A | * | 6/1973 | Verbeke | 232/15 |
| 3,837,566 | A | * | 9/1974 | McGough | 232/15 |
| 3,926,366 | A | | 12/1975 | Sciortino | |
| 5,009,365 | A | * | 4/1991 | Holtzer | 232/16 |
| 5,038,908 | A | * | 8/1991 | McGough | 194/350 |

FOREIGN PATENT DOCUMENTS

| | | | |
|---|---|---|---|
| DE | 324768 | | 9/1920 |
| DE | 3429779 | A1 | 4/1985 |
| EP | 0201427 | A2 | 12/1986 |
| EP | 0561579 | A2 | 9/1993 |
| EP | 0571188 | A2 | 11/1993 |
| WO | 8500905 | A1 | 2/1985 |

* cited by examiner

*Primary Examiner* — William L. Miller
(74) *Attorney, Agent, or Firm* — Bacon & Thomas, PLLC

(57) ABSTRACT

A container for receiving coins and/or documents of value having a container housing with at least one feed opening, a sealing element which is movable between a sealing position to block the feed opening and an open position in which the feed opening is opened to allow the feeding of coins or documents of value, and a biasing element which biases the sealing element in the direction of the sealing position in the open position. The container also includes an actuating opening that receives an actuating element to move the sealing element out of the sealing position into the open position, a catch device which has a catch element, and a closing device that enables the catch device to be displaced out of the catch state into the ready state.

11 Claims, 4 Drawing Sheets

CONTAINER FOR ACCOMMODATING COINS AND/OR VALUABLE DOCUMENTS

FIELD OF THE INVENTION

The present invention relates to a container, in particular a security container, for receiving coins and/or documents of value.

BACKGROUND

Documents of value in the following refer to sheet-shaped objects, which for example represent a monetary value or an authorization and thus shall not be producible at will by unauthorized persons. Therefore, they have features not easy to manufacture, in particular to copy, whose presence is an indication of the authenticity, i.e. the manufacturing by a body authorized thereto. Important examples of such documents of value are coupons, vouchers, checks and in particular bank notes.

Coins and documents of value are still common means of payment. For many purposes it is necessary to collect and to transport coins or documents of value. For example, shops collect their takings throughout the day and transport them to a bank after closing time. So as to impede an unauthorized access to the means of payment, these often are collected and transported in security containers.

Security containers in the following refer to containers which have a container housing that is so stable that in a resting state it cannot be manually forced open without using tools. For example, such container housings may be produced from metal or an impact-resistant and/or break-proof plastic material or a composite material or at least two of these materials.

Coins or documents of value often are automatically accepted by means of appropriate automatic teller machines or vending machines, coins and documents of value present in manually operated cash registers often are counted in automatic apparatuses and, if necessary, checked as to authenticity even before the transport. In both cases it proves to be practical to use security containers which can be inserted in a closed state in such apparatuses and automatically filled by these. For this purpose the security containers have at least one feed opening through which the coins or documents of value can be fed to the security container.

Depending on the type of security container, however, it is conceivable that coins or documents of value received in the security container can be removed from the security container through the feed opening or shaken out through said opening. I.e. that although an opening of the security container is not readily possible, coins or documents of value could be removed from the security container.

SUMMARY

The present invention is therefore based on the object to provide a container, in particular a security container, for receiving coins and/or documents of value having a feed opening, said container, after the filling in suitable apparatuses, in a closed state substantially impeding, preferably even preventing, a removal of coins or documents of value through the feed opening.

The object is achieved by a container, in particular a security container, for receiving coins and/or documents of value, comprising a container housing for receiving fed coins or documents of value, at least one feed opening formed in the container housing for the feed of coins or documents of value into the container housing, a sealing element disposed within the container housing and being movable back and forth between a sealing position, in which the sealing element blocks the feed opening at least so far that coins or documents of value are not removable from the container through the feed opening, and an open position, in which the feed opening is released and a feed of coins or documents of value into the container is possible, a biasing element coupled with the container housing and the sealing element, which biases the sealing element at least in the area of the open position in the direction of the sealing position, and an actuating opening through which a predetermined actuating element can reach into the container and/or a movable actuating element of the container can project outward and, upon movement in the direction of an interior space of the container housing, move the sealing element out of the sealing position into the open position, and/or a movable actuating element of the container and/or of a portion of the sealing element can project outward and, upon movement in the direction of an interior space of the container housing, move the sealing element out of the sealing position into the open position. The container further comprises a catch device which comprises a catch element movable back and forth between a ready position and a catch position and in the catch position holding the sealing element in the sealing position, said device being displaceable back and forth between a ready state, in which the catch element is pushed away out of the catch position into the ready position, and a catch state, in which the catch element is pushed towards the catch position, as well as a closing device by means of which the catch device can be displaced out of the catch state into the ready state. The catch device and the sealing element here are coupled such that by a movement of the sealing element out of the sealing position into the open position the catch device is displaced out of the ready state into the catch state.

Depending on the embodiment, the container may serve to receive coins or documents of value or coins and documents of value. For this purpose, on the one hand the feed opening is appropriately designed, on the other hand in the interior of the container can be located still other devices, for example for directing coins or documents of value and/or for stacking documents of value. But to keep the feed opening as small as possible, a container according to the invention is preferably formed only for receiving coins or only for receiving documents of value. The interior space of the container enclosed by the container housing in principle may be designed like the interior space of a known container or security container for documents of value and/or coins.

The container allows an especially simple securing of the feed opening

At first, with the help of the closing mechanism the catch mechanism is moved into the ready state in which the sealing element is in the sealing position and thus blocks the feed opening Further, in this state the catch element is pushed away out of the catch position into its ready position. For this purpose, over a predetermined area of positions of the catch element near the ready position there can be exerted an appropriate force and/or an appropriate torque directly on the catch element or a component connected therewith.

When the container is slid into an apparatus issuing the coins or documents of value, into a corresponding receiving means for the container, on the one hand the sealing element is moved into the open position where the feed opening is released. Depending on the embodiment of the container, three possibilities are provided which, if appropriate, can also be combined. In each one of the cases, the container housing has the actuating opening through which reaches the respective element that moves the sealing element when the container is moved into the receiving means.

On the one hand, the apparatus, for example its receiving means, may have an actuating element which upon the movement of the container into the receiving means at least partially reaches through the actuating opening into the container housing and moves into the container housing, whereby it moves the sealing element out of the sealing position into the open position. For this purpose, the container, the receiving means and the actuating element have to be adjusted to each other in terms of arrangement and formation.

On the other hand, the container may have the movable actuating element which in the sealing position of the sealing element protrudes out of the container housing and upon movement of the container first stops with said container at a corresponding stop of the apparatus, for example the receiving means, and in continuation of the movement of the container into the receiving means is moved into the container housing where it moves the sealing element out of the sealing position into the open position.

Further, the actuating element can also be constituted by a portion of the sealing element. The function corresponds to the function in the second possibility, except that sealing element and actuating element are forced to move simultaneously.

The actuating opening is preferably chosen so small that neither coins nor documents of value can be removed from outside from the interior space through the actuating opening.

In the open position an access to the feed opening by users is typically prevented in that the apparatus has parts reaching into the area of the feed opening of the container which is disposed in the receiving means, which impede or prevent an access to the feed opening.

Upon the or by the movement of the sealing element into the open position the catch device is displaced out of the ready state into the catch state, in which the catch element is pushed towards the catch position but cannot yet take up said catch position. For this purpose, over a predetermined area of positions of the catch element around or at the ready position there can be exerted an appropriate force and/or an appropriate torque directly on the catch element or a component connected therewith.

After the removal of the container from the receiving means the sealing element returns into the sealing position by the effect of the biasing element, because on the actuating element or the portion of the sealing element there cannot be exerted any forces any longer by the apparatus or receiving means.

Since the catch device is in the catch state, the catch element is pushed towards the catch position, which it takes up at the latest by the time the sealing element has arrived at the sealing position.

The catch element now catches with the sealing element, more precisely a portion of the sealing element complementary to the catch element, so that said catch element cannot leave the sealing position. This means, that the sealing element is withheld in the sealing position and cannot be moved relative to the feed opening, unless the catch device is displaced into the ready state.

The catch device can be displaced into the ready state by the closing device being actuated, by means of which the catch device can be displaced out of the catch state into the operating state.

Preferred developments and embodiments are described in the description, the Figures and the claims.

In principle, the sealing element can be guided in any desired way so as to be movable back and forth between the sealed and the open positions. However, in the case of the container the sealing element is preferably mounted so as to be shiftable back and forth between the sealed and the open positions, in particular linearly. This has the advantage that the container can be easily used together with apparatuses where containers are slid into corresponding receiving means. It is then unnecessary to convert the linear sliding movement of the container relative to the receiving means into a corresponding movement of the sealing element relative to the feed opening, which may substantially simplify the structure of the container.

In principle, the catch device can be displaced in any desired way out of the ready state into the catch state. But the advantage of an especially simple structure is obtained by the catch device and the sealing element being formed such that the sealing element upon movement into the open position displaces the catch device out of the ready state into the catch state.

The biasing element can be formed in various ways. It is also possible to use several biasing elements, which may be formed identically or different, for example according to the variants mentioned in the following. The biasing element can be held at the sealing element and the container housing or a part firmly connected therewith. This embodiment allows in particular the use of coil springs as elastic element, which has the advantage that the spring constant and thus the bias can be easily chosen.

But it is also possible that the biasing element comprises a resilient portion which at least in the open position lies against the container housing or a part connected therewith. The resilient portion can be in particular a coil spring or leaf spring held in or at the sealing element. The advantage of an especially simple assembly is obtained, when the biasing element is integrally formed with the sealing element, which is in particular favorable when the sealing element is produced from a, preferably injection-moldable, plastic material.

Furthermore, the biasing element may be formed or held at the container housing or a part connected therewith and be coupled at least in the open position with the sealing element. This embodiment may prove to be advantageous, when an especially simple structure of the container, more precisely of the part comprising the sealing element and the catch device, is requested.

In principle, the catch element can be moved largely independently of the sealing element. But it is especially preferred that the catch element, upon its movements relative to the sealing element, lies against a closed edge in an opening and/or recess in the sealing element. The catch element may in particular be guided at the edge of the opening or recess. By a corresponding formation of the opening and/or recess, the sealing element can thus move the catch device out of the ready state into the catch state by movement out of the sealed into the open position. The catch element in particular can thus be guided in the manner of a cam guide in the opening or recess.

In principle, the catch element can move in any desired way relative to the sealing element, provided that the sealing element's function allows this. But the sealing element and the catch element are preferably mounted such that they move between their positions in planes extending parallel to each other. This embodiment has the advantage that the mechanism formed by the sealing element, the biasing element and the catch device can be formed very flat and thus takes up little space in the container housing.

The catch device, in principle, can be formed in any fashion, provided that it fulfills the mentioned functions. The advantage of an especially simple structure, however, can be achieved in that the catch device comprises a three-armed lever rotatable around a rotation axis, at the first arm of which the catch element is disposed, at the second arm of which acts a further resilient element which is connected with a portion of the container that is fixed relative to the rotation axis, and the third arm of which is actuatable by the closing device. The lever in particular can be formed as an injection-molded part made of plastic material, which may substantially cheapen the manufacturing of the lever.

So as to permit the two states in a simple fashion, the further resilient element can then be disposed in particular such that it passes the rotation axis upon changing between the two states of the catch device. One end of the further resilient element, for example a coil spring, here can be firmly held relative to the rotation axis. A simple change of a direction of a torque acting on the lever can be achieved hereby.

Since the mechanism comprises movable parts, it possibly may be hindered or damaged when it lies exposed. It is thus preferred that the apparatus comprises a covering element disposed within the container housing, which covers the sealing element and at least a part of the catch device. The sealing element and the part of the catch device are then disposed protected between the covering element and the container housing. The covering element in particular can be connected with at least a portion of the container housing and thus serve as a holder or support for [sic] part of the described mechanism.

So as to be able to remove coins or documents of value fed to the container, in the case of the container the container housing preferably has a swivelling housing member, which in an open position enables access to coins or documents of value through a housing opening in the container, in a closing position closes the housing opening so far as to prevent an access. So as to impede or prevent an unauthorized opening of the container and simultaneously be able to actuate the catch device, the swivelling housing member, for example a door or a lid, is lockable preferably by means of the closing device in the closing position.

The container housing is preferably produced from a metal or a plastic material or a composite material or at least two of these materials, the materials and the formation of the container being chosen such that the container, that is in a resting state, cannot be opened without tools, without unlocking a possibly present mechanical or electrical lock.

Further object of the invention is a receiving means for a container according to the invention having an actuating element which upon the insertion of the container in the receiving means moves the sealing element into the open position.

BRIEF DESCRIPTION OF THE DRAWINGS

In the following the invention is still further explained by way of example with reference to the Figures.

DETAILED DESCRIPTION OF EXEMPLARY EMBODIMENTS OF THE DISCLOSURE

Figure 1:
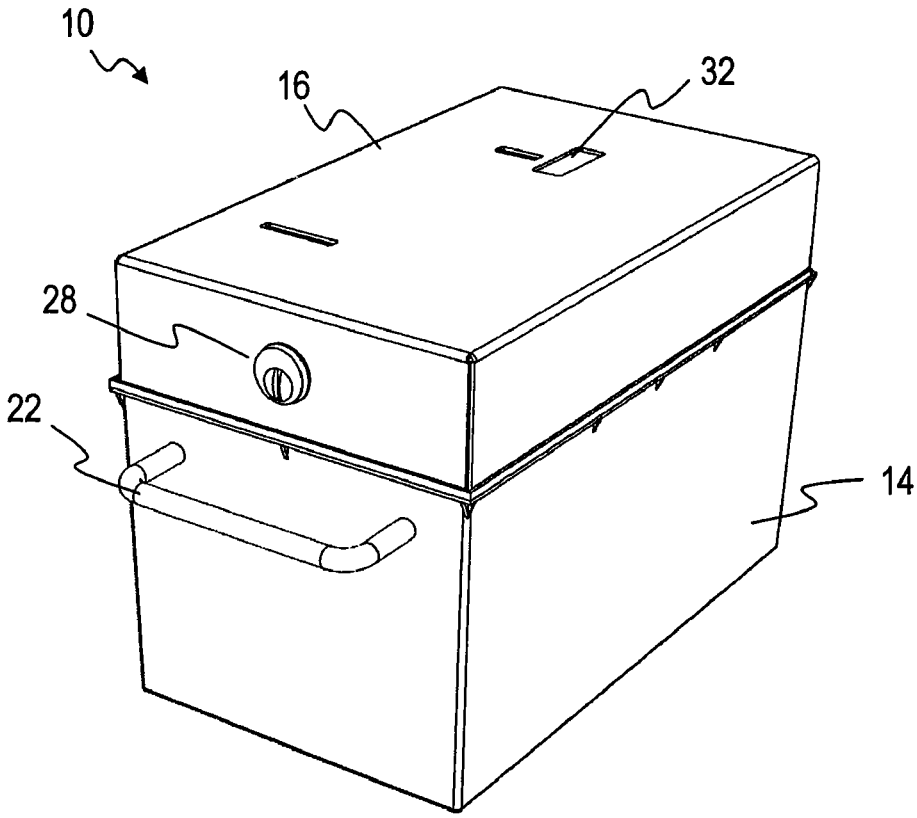
FIG. 1 shows a perspective view of a container for coins from above front right.
Figure 2:
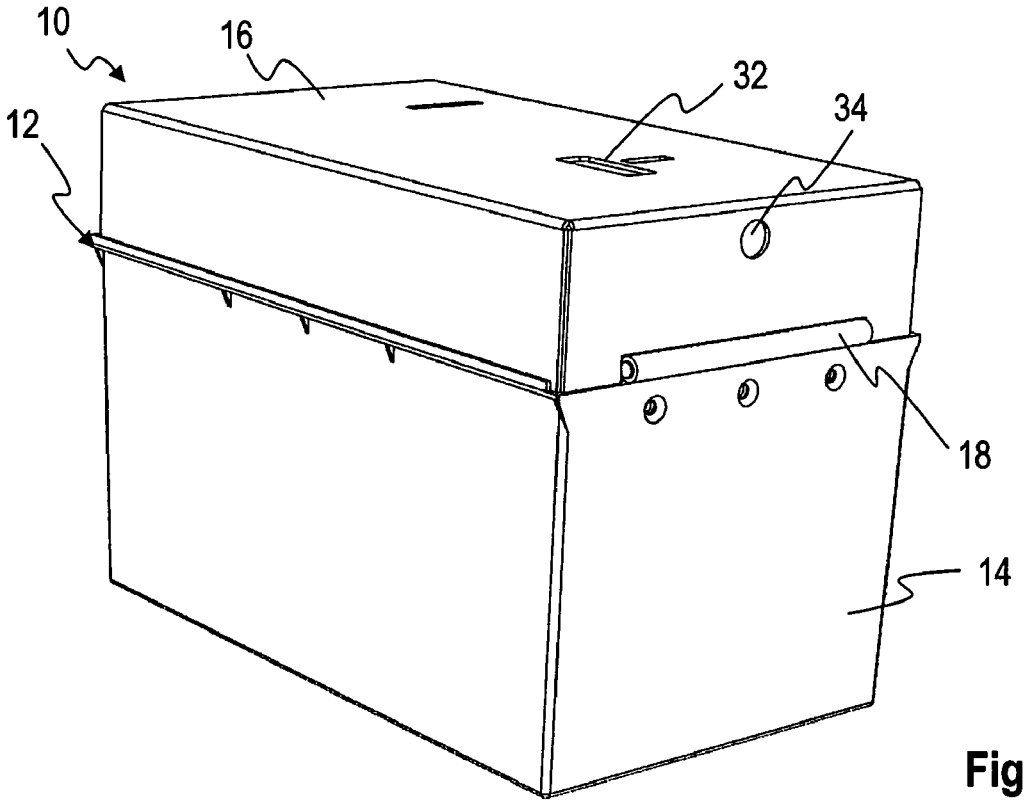
FIG. 2 shows a perspective view of a container for coins from above back right.
Figure 3:
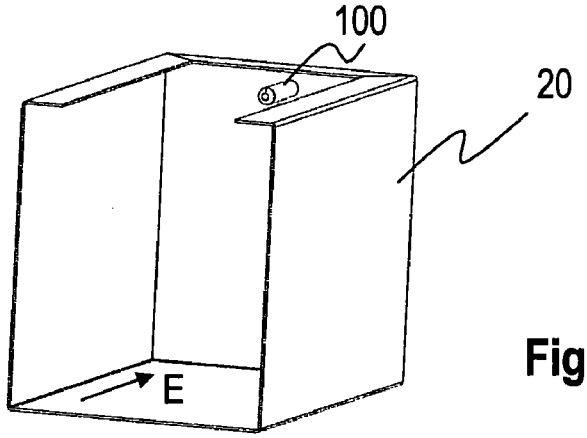
FIG. 3 shows a perspective view of a receiving means for the container in the FIGS. 1 and 2.

A container 10, in the example security container, for receiving coins in the FIGS. 1 and 2 has a container housing 12, which has a bottom housing member 14 and an upper housing member 16 which by means of a hinge 18 is held as to be swivelling at the bottom housing member 14. Upon swivelling up the upper housing member 16 into an open position, a housing opening 17 is obtained through which the content of the container can be accessed, whereas the upper housing member 16 in a closing position, in which the upper housing member 16 is swivelled down onto the bottom housing member 14 and rests on it and closes the housing opening 17, refuses access to the interior space of the container housing 12.

The container 10 is intended for being slid into a receiving means 20 which may be incorporated for example in a not shown coin accepting and/or dispensing apparatus, in a sliding direction E, in the example extending parallel to that edge of the container housing 12 which has the greatest length.

The container 10 can be manufactured from any suitable materials, which protect the interior space from an unauthorized access, at least without the use of tools. In the example the bottom housing member 14 is manufactured from an impact-resistant technical plastic material, for example polyamide, whereas the upper housing member 16 is manufactured from a metal.

Figure 4:
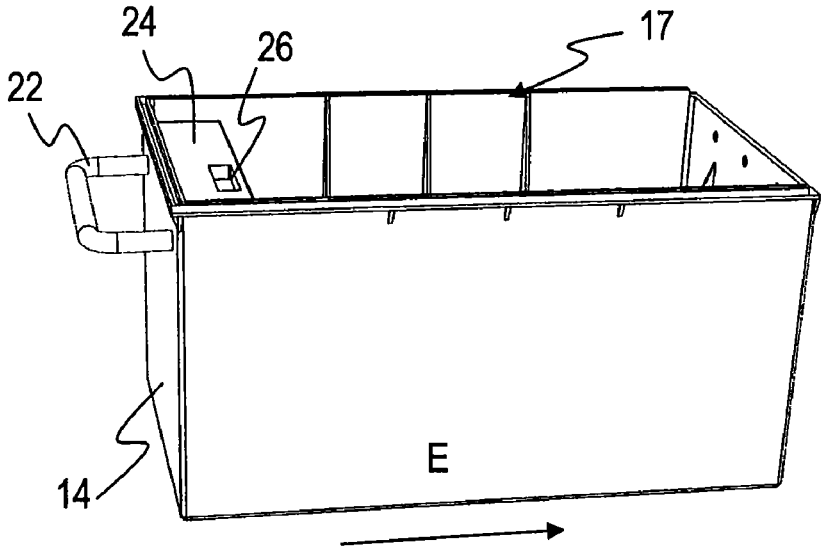
FIG. 4 shows a perspective side view of a bottom housing member of the container in the FIGS. 1 and 2.

As it can be recognized in FIGS. 1 and 4, the bottom housing member 14 is of a box-type form and is provided at its outside front side with a bow-type handle 22 and inside with a ledge 24 with a locking opening 26 for a closing device to be described below. At the wall opposite the front side there is fastened the hinge 18 that is not shown in FIG. 4.

The upper housing member 16 that is also of a box-type form is provided at its front side with an opening, in which a lock 28 of a closing device 30 is held, and a feed opening 32, through which coins of predetermined sizes can be fed into the interior space enclosed by the container housing 12. Furthermore, at the side of the upper housing member 16 which opposes the front side there is disposed an actuating opening 34, through which an actuating element can reach inside the upper housing member 16 and thus the container housing 12.

Figure 5:
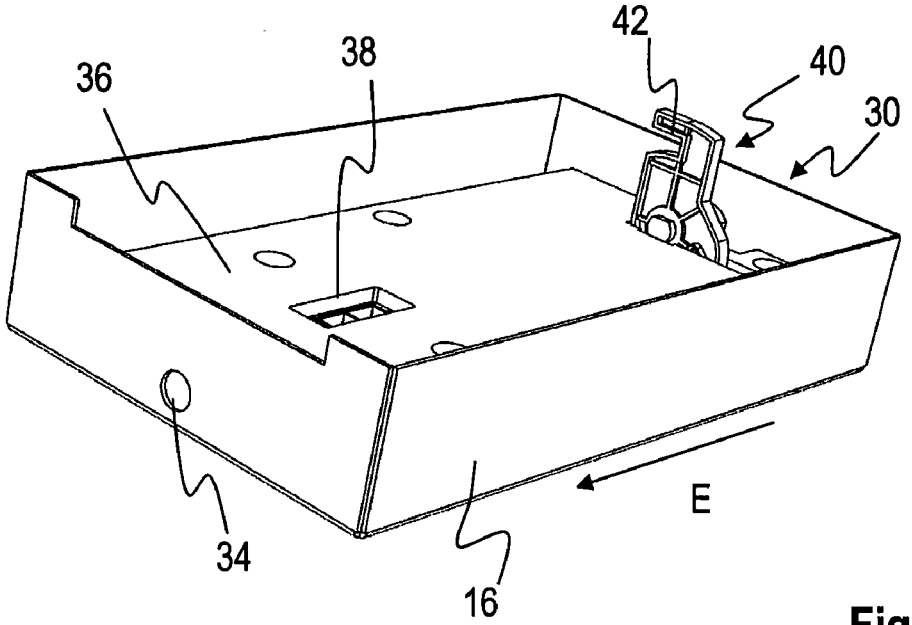
FIG. 5 shows a perspective view of an upper housing member swivelling in relation to the bottom housing member of the container in the FIGS. 1 and 2, from obliquely behind, said upper housing member being rotated by 180° around its longitudinal axis.

In the upper housing member 16, which in FIG. 5 is shown in a position upside down without the hinge 18, there is firmly held a covering element 36 which has a passage opening 38 aligned with the feed opening 32 of the same size, which is disposed such that coins falling through the feed opening 32 can also fall through the passage opening 38. There is further provided a recess for the closing device 30, which besides the lock 28 further comprises a closing element 40 connected with a shaft of the lock 28 and rotatable around the rotation axis of said shaft. Except for the recess and the passage opening 38, the covering element 36 largely, preferably substantially completely, covers the inside of the upper housing member 16.

Figure 9:
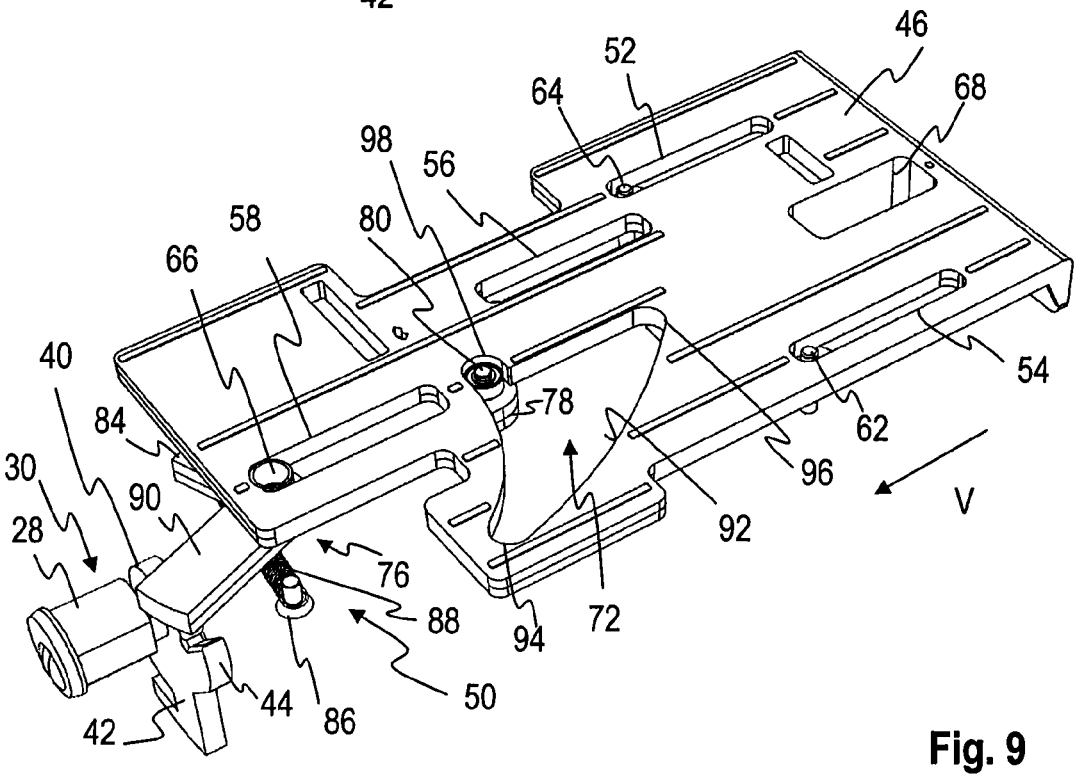
FIG. 9 shows a perspective view of the devices and elements in FIG. 7, where the devices and elements are rotated by 180° around the longitudinal axis relative to the view in FIG. 7, and the closing device is in the locked position, the catch device in the catch state, a catch element of the catch device in its catch position and the sealing element in a sealing position.

The closing element 40, better recognizable in FIG. 9, is provided with a locking hook portion 42 which is disposed such that after correspondingly swivelling it can reach into the locking opening 26, when the upper housing member 16 is in the closing position.

The closing element 40 is further provided with an actuating portion 44, whose function will be described in more detail below.

Figure 6:
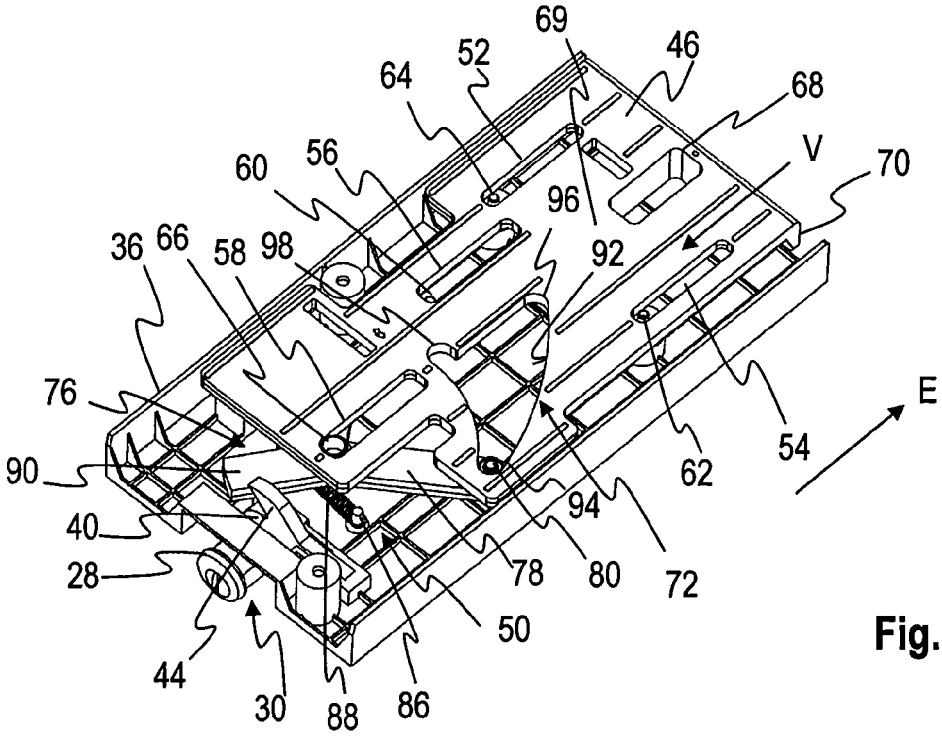
FIG. 6 shows a perspective view of a covering element having a catch device, a sealing element and a closing device, which is disposed in the upper housing member in FIG. 5.

Between the covering element 36 and the upper housing member 16 there are disposed a sealing element 46, a biasing element 48, in the example a coil spring, coupled with the container housing 12 via the covering element 36 and the sealing element 46, and a catch device 50. As shown in FIG. 6, the covering element 36 serves as a carrier or holder for the sealing element 46, the biasing element 48 and the catch device 50. The sealing element 46, the biasing element 48 and the catch device 50 together are referred to as sealing device in the following.

As it can be recognized in the FIGS. 6 to 9, the sealing element 46 has plate-type form. In the sealing element 46 there are formed four guide slots 52, 54, 56 and 58 extending in a shifting direction V of the sealing element 46 relative to the catch device 50, in the example extending in longitudinal direction of the sealing element 46 and thus in both the longitudinal direction of the upper housing member 16 and the sliding direction E, into which reach corresponding guiding elements 60, 62, 64 and 66 mounted at the covering element 38, so that the sealing element 46 is guided so as to be linearly shiftable along its shifting direction V, in the example against the sliding direction E.

In the sealing element 46 there is further formed in the rear part a pass-through opening 68, which in an open position of the sealing element 46, which is described in more detail below, aligns with the feed opening 32 and the passage opening 38 and is dimensioned such that coins falling through the feed opening 32 arrive in the passage opening 38. A portion 69 located in shifting direction V behind the pass-through opening 68, which has approx. the same dimensions as the pass-through opening, is reinforced, in the example by ribs, so that it is more stable against loads orthogonally to the plane of the sealing element 46.

At the rear end of the sealing element 46 there is formed a stop 70 in the form of a stop bar, which extends transverse to the longitudinal direction and thus sliding direction E.

Moreover, in the sealing element 46 there is formed a guiding opening 72, whose form and function is described in more detail below.

The biasing element 48, a suitably dimensioned coil spring, is held between a projecting part 74 at the sealing element 48 and the guiding element 60 such that it exerts a bias or force on the sealing element 48 in the direction of the stop 70 or against the shifting direction V.

The catch device 50 is provided with a three-armed lever 76 mounted to be rotatable at the guiding element 66 and aerially formed in parallel to a plane, a catch element 80 fastened or formed at an end of a first arm 78 of the lever 76, and a further resilient element 88, in the example a coil spring, held at a projecting part 82 of a second arm 84 of the lever 76 and at a pin 86 held at the covering element 36, said resilient element being connected in this fashion, by means of the covering element 36, with a firm portion of the container 10 relative to the rotation axis extending through the guiding element 66, more precisely the upper housing member 16.

The third arm 90 of the lever 76 is actuatable by the actuating portion 44 of the closing device 30, i.e. by swivelling the actuating portion 44 against the third arm 90, the lever 76 can be rotated from a predetermined position in at least one direction into a different predetermined position.

The guiding element 66 and thus the rotation axis for the lever 76 extends substantially orthogonally to the plane of the sealing element 46, so that the sealing element 46 and the catch element 80 are mounted such that they move between their positions in planes extending parallel to each other.

The lever 76 is further mounted and formed such that the catch element 80 lies in the guiding opening 72.

Figure 7:
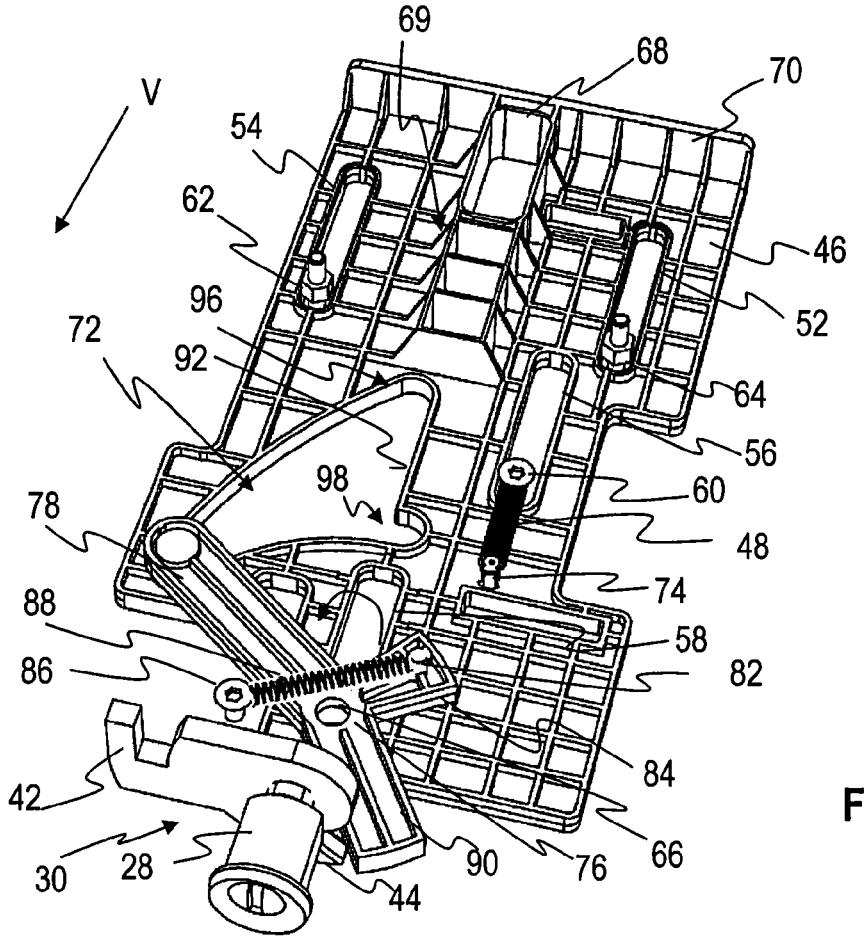
FIG. 7 shows a perspective view of the catch device, of the sealing element and the closing device in FIG. 6 rotated by 180° around the longitudinal axis of the sealing element from the upper front, where like in FIG. 6 the closing device is in an unlocked position, the catch device in a ready state and the sealing element in a sealing position.

The catch device can take up two states, a ready state and a catch state. The fastening points of the resilient element 88, the projecting part 82 and the pin 86, are chosen such that by means of the second arm 84 on the lever 76 a torque in different directions is exerted, depending on the position of the lever 76. In the ready position shown in FIG. 7 the resilient element 88 exerts a force on the second arm 84, which in the representation in FIG. 7 lies behind the guiding element 66 or the rotation axis. The result is a torque on the lever indicated by an arrow, which in the representation in FIG. 7 is directed counter-clockwise. In the catch state shown in FIGS. 8 and 9, however, the lever 76 takes up positions, in which the force of the resilient element 88 on the second arm 84, as seen in the representation in FIG. 7, extends along a direction before the guiding element 66 or the rotation axis. Thus, a torque is exerted clockwise on the lever 76.

The guiding opening 72 is formed adjusted to the formation of the catch device 50 such that on the one hand the catch element 80 upon its movements relative to the sealing element 46 lies against a closed edge 92 of the guiding opening 72 in the sealing element 46 and thus is guided at said edge 92.

The guiding opening 72 is provided with three corners, which correspond to three positions of the catch element 80, which said catch element takes up in dependence on the state of the catch device 50 and the position of the sealing element 46. These are described in more detail in the following in connection with the function of the sealing mechanism. Two of the corners, the corners 94 and 96, allow a movement of the catch element in at least one direction extending parallel to the shifting direction V, whereas the corner 98, which is formed as a U-shaped recess or bulging with legs of the "U" extending transverse to the shifting direction V, blocks a movement of the sealing element 46 in the shifting direction V and thus effects a catch.

The sealing device works in the following cycle.

For simplicity's sake the cycle is described beginning with the not locked or unlocked state of the container 10.

With an open container 10 or when the closing device 30 or the closing element 40 are in an unlocked position (cf. FIGS. 6 and 7), the catch device 50 is in the ready state. In this state on the lever 76 acts a torque, which in the representation in FIG. 7 is directed counter-clockwise, by means of which the catch element 80 is pushed or moved along the edge of the guiding opening 72 into a ready position in the corner 94. The sealing element 46 is pulled into its sealing position by the action of the biasing element 48, in the example in the direction of the stop 70, in which it at least partially covers, in the example completely covers and thus locks and blocks, the feed opening 32 and the passage opening 38 with the above-mentioned portion 69, so that from the container 10 there cannot be removed coins through the feed opening 32 nor can they be fed to it. Furthermore, the end of the actuating portion 44 of the closing element 40 is located at least near the end of the third arm 90 of the lever 76.

The (empty) container 10 can now be locked in the closing position, in which the upper housing member 16 is swivelled onto the bottom housing member 14, by means of the closing device 30 by closing the lock 28 and thus turning the closing element 40. In doing so, on the one hand, the locking hook portion 42 reaches into the locking opening 26 and locks or secures the upper housing member 16 with or at the bottom housing member 14. On the other hand, the end of the actuating portion 44 of the closing element 40 is moved away from the end of the third arm 90 of the lever 76, so that the lever 76 can be turned, in the representation of the FIG. 7, clockwise. Since the catch device 50 is still in the ready state and no force is exerted on the sealing element 46, the feed opening is still closed.

In this state the (empty) container 10 can be slid into the receiving means 20 in sliding direction E. The receiving means 20 has, adjusted to the construction of the container 10, corresponding to the position of the actuating opening 34 in the container 10, a pin-shaped actuating element 100 projecting against the sliding direction E, which upon the sliding of the container 10 into the receiving means 20 reaches through the actuating opening 34, stops at the sealing element 46, more precisely the stop 70, and moves the sealing element 46 relative to the container housing 12 or the upper housing member 16, to the covering element 36 and to the catch device 50 in shifting direction V, in the example towards the closing device 30, and thus further biases the biasing element 48. The biasing element 48 exerts a backward driving force on the sealing element, which, however, is held in its position by the actuating element 100. The length of the actuating element 100 is chosen such that the sealing element 46 comes to rest in an open position, in which the pass-through opening 68 aligns with the feed opening 32 and the passage opening 38, so that coins can fall through the feed opening 32 into the container 10. A removal is not possible due to the structure of the receiving means 20 and of the coin accepting and/or dispensing apparatus, since the feed opening is not accessible for a person without a removal of the container 10 from the receiving means 20.

Figure 8:
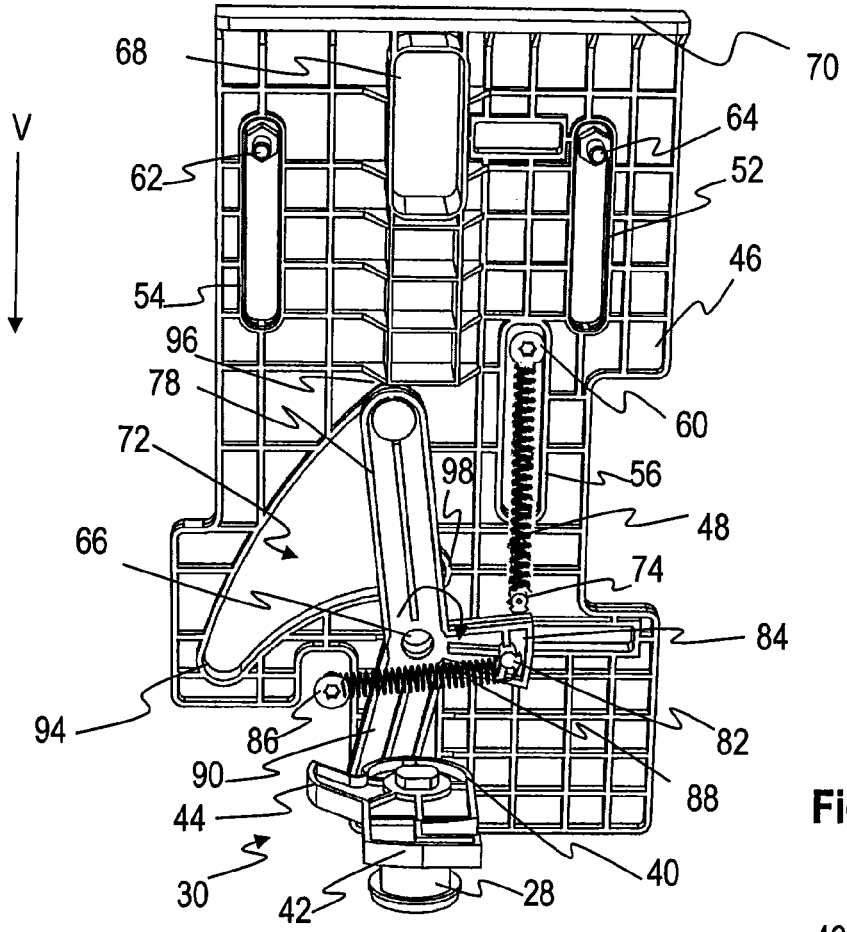
FIG. 8 shows a perspective view of the devices and elements in FIG. 7, where these are tilted upright relative to the position in FIG. 7 and the closing device is in a locked position, the catch device in a catch state and the sealing element in the open position.

Upon the movement of the sealing element 46 out of the sealing position into the open position, the catch device 50 is simultaneously displaced into the other state, the catch state. The catch device 50 and the sealing element 46 are coupled by the guiding of the catch element 80 in the suitably formed guiding opening such that by a movement of the sealing element 46 out of the sealing position into the open position the catch device 50 is displaced out of the ready state into the catch state. More precisely, this happens because the edge of the guiding opening 72, upon the relative movement of catch device 50 and sealing element 46 in parallel to the shifting direction V, by the course of the edge which extends obliquely to the shifting direction V, in the example is curved, also moves the catch element 80 orthogonally to the shifting direction and thus the lever 76, in the representation in FIG. 7, is turned clockwise. In so doing, the resilient element 88 is guided via the guiding element 66 or the rotation axis of the lever 76, so that, as soon as it has crossed the connecting line between the pin 86 and the projecting part 82 i.e., the rotation axis, the force exerted on the third arm by the resilient element 88 effects a clockwise torque (in the representation of FIG. 7). This torque moves the lever 76 and thus the catch element 80. The movement is effected until the catch element 80 has arrived at the corner 96, where the edge of the guiding opening prevents a further movement transverse to the shifting direction V. This situation is illustrated in FIG. 8. The resilient element 88 is still at least somewhat biased, so that a torque still acts clockwise on the lever 76.

If now the container 10 is removed from the receiving means 20 by pulling it out against the sliding direction E, the actuating element 100 is pulled out of the actuating opening 34. The biasing element 48 now pulls the sealing element 46 against the shifting direction V in the direction of the sealing position, which the sealing element 46 achieves as soon as the actuating element 100 does no longer lie against the stop 70. This state is shown in FIG. 9. As already described for the initial state, in the sealing position a removal of coins through the feed opening 32 is no longer possible. The content of the container 10 is now protected against access, in particular also because now the reinforced portion 69 covers the feed opening 32.

Upon this movement of the sealing element 46 relative to the container 10 and in particular to the catch device 50, the catch element 80 is guided at the, in the representation in FIG. 7 right, edge of the guiding opening 72 in the direction of the third corner 98, whereby it lies against the edge by the action of the torque in the catch state. The sealing element 46 and the catch device 50 are formed adjusted to each other such that when the sealing position is achieved the catch element 80 snaps into its catch position in the corner 98 or the U-shaped bulging, in which it is held by the torque which continues to act in the catch state. Since the legs of the "U" extend transverse to the shifting direction and the width approx. corresponds to the diameter of the pin-shaped catch element 80, the sealing element 46 can no longer be moved in the or against the shifting direction V, but is rather caught in the sealing position.

The container 10 is therefore also protected against a person attempting to move the sealing element 46 into the open position by means of a tool.

If now the container 10 is opened by actuating the closing device 30, the closing element 40, in the representation of FIG. 9, is moved counter-clockwise. The actuating portion 44 here stops at the third arm 90 of the lever 76 and turns said lever into the ready position, the resilient element 88 again crossing the rotation axis or the guiding element 66 and the direction of the exerted torque reversing, whereby again the ready state is obtained.

The container 10 in a closed state does not only impede or prevent a removal of coins or documents of value through its feed opening after filling in suitable apparatuses, for this purpose it rather needs no more than the actuation of a closing device for opening or locking the container, which is necessary anyway with most of the containers.

In other embodiments the actuating element 100 can also be formed, instead of at the receiving means, as a projecting part at the sealing element 46, which in the sealing position projects out of the housing by the required length. Alternatively, there can also be provided a movable actuating element in the container, which, likewise, in the sealing position projects out of the housing by the required length.

Furthermore, it is not necessary that the biasing element 48 is directly connected with the sealing element 46 and the container housing 12 by means of the covering element.

The biasing element can also be disposed at the sealing element at the side opposing the stop. If the sealing element is formed as an injection-molded part like in the first embodiment, it can in particular be integrally formed with the sealing element, and in an unbiased state can be formed for example arc-shaped. Upon the movement into the open position, the arc is then compressed.

Alternatively, the biasing element can also be held at the upper housing member 16, for example acting in the manner of a leaf spring or in the form of at least one compression spring.

In other embodiments the feed opening for passing through documents of value, for example bank notes, and the container housing is formed corresponding to a free-fall cassette, but otherwise unchanged.

In still other embodiments the feed opening may be disposed in one of the side walls of the container housing. Then the sealing device may be disposed accordingly along the side wall, for example in a vertical instead of in a horizontal direction.

The invention claimed is:

1. A container for receiving coins, documents of value, or combinations thereof, comprising:

a container housing for receiving fed coins or documents of value, at least one feed opening formed in the container housing for receiving coins or documents of value into the container housing, a sealing element disposed within the container housing and being movable back and forth between a sealing position and an open position, wherein in the sealing position the sealing element blocks the feed opening so that coins or documents of value are not removable from the container through the feed opening, and wherein in the open position the feed opening is open so that receipt of coins or documents of value into the container is enabled, a biasing element coupled with the container housing and the sealing element, said biasing element arranged to bias the sealing element in the direction of the sealing position when in the open position, an actuating opening configured to receive an actuating element, said actuating element when received in the actuating opening moving the sealing element from the sealing position to the open position, said actuating element being arranged to at least one of; project into the container; project outward of the container; or to be movable; and to project outward of the container, a catch device comprising a catch element arranged to move between a ready position and a catch position, wherein in the catch position, the catch element is arranged to hold the sealing element in the sealing position, and wherein in the ready position, the catch element enables the movement of the sealing element between said sealing position and said open position, a closing device arranged to displace the catch device from the catch position to the ready position, and the catch device and the sealing element being coupled so that movement of the sealing element out of the sealing position into the open position displaces the catch device out of the ready position into the catch position, and wherein the sealing element further comprises at least one of an opening and recess having a closed edge, and the catch element upon its movements relative to the sealing element lies against said closed edge in the at least one of the opening and recess in the sealing element.

2. The container according to claim 1, wherein the sealing element and the catch element are mounted such that they move between their positions in planes extending parallel to each other.

3. The container according to claim 1, wherein the catch device comprises a three-armed lever rotatable around a rotation axis including a first arm having the catch element disposed thereon, a second arm having a further resilient element having one end connected with a portion of the container that is fixed relative to the rotation axis and another end connected to the second arm, and a third arm arranged to be actuatable by the closing device.

4. The container according to claim 3, wherein the further resilient element is arranged such that it crosses over the rotation axis upon changing between the two positions of the catch device.

5. The container according to claim 3, wherein the further resilient element is arranged such that it crosses over the rotation axis upon changing between the two positions of the catch device.

6. The container according to claim 1, including a covering element disposed within the container housing which covers the sealing element and at least a part of the catch device.

7. The container according to claim 1, wherein the container housing comprises a swivelling housing member which is arranged so that in an open position access to coins or documents of value through a housing opening in the container is enabled, and in a closing position the housing opening is closed to prevent access to the coins or documents of value; said swivelling housing member being lockable in the closing position by the closing device.

8. A container for receiving coins, documents of value, or combinations thereof, comprising:

a container housing for receiving fed coins or documents of value, at least one feed opening formed in the container housing for receiving coins or documents of value into the container housing, a sealing element disposed within the container housing and being movable back and forth between a sealing position and an open position, wherein in the sealing position the sealing element blocks the feed opening so that coins or documents of value are not removable from the container through the feed opening, and wherein in the open position the feed opening is open so that receipt of coins or documents of value into the container is enabled, a biasing element coupled with the container housing and the sealing element, said biasing element arranged to bias the sealing element in the direction of the sealing position when in the open position, an actuating opening configured to receive an actuating element, said actuating element when received in the actuating opening moving the sealing element from the sealing position to the open position, said actuating element being arranged to at least one of: project into the container; project outward of the container; or to be movable; and to project outward of the container;

a catch device comprising a catch element arranged to move between a ready position and a catch position, wherein in the catch position, the catch element is arranged to hold the sealing element in the sealing position, and wherein in the ready position, the catch element enables the movement of the sealing element between said sealing position and said open position, a closing device arranged to displace the catch device from the catch position to the ready position, the catch device and the sealing element being coupled so that movement of the sealing element out of the sealing position into the open position displaces the catch device out of the ready position into the catch position, and wherein the catch device comprises a three-armed lever rotatable around a rotation axis including a first arm having the catch element disposed thereon, a second arm having a further resilient element having one end connected with a portion of the container that is fixed relative to the rotation axis and another end connected with the second arm, and a third arm arranged to be actuatable by the closing device.

9. The container according to claim 8, including a covering element disposed within the container housing which covers the sealing element and at least a part of the catch device.

10. The container according to claim 8, wherein the container housing comprises a swivelling housing member which is arranged so that in an open position access to coins or documents of value through a housing opening in the container is enabled, and in a closing position the housing opening is closed to prevent access to the coins or documents of value; said swivelling housing member being lockable in the closing position by the closing device.

11. A container for receiving coins, documents of value, or combinations thereof, comprising:

a container housing for receiving fed coins or documents of value, at least one feed opening formed in the container housing for receiving coins or documents of value into the container housing, a sealing element disposed within the container housing and being movable back and forth between a sealing position and an open position, wherein in the sealing position the sealing element blocks the feed opening so that coins or documents of value are not removable from the container through the feed opening, and wherein in the open position the feed opening is open so that receipt of coins or documents of value into the container is enabled, a biasing element coupled with the container housing and the sealing element, said biasing element arranged to bias the sealing element in the direction of the sealing position when in the open position, an actuating opening configured to receive an actuating element, said actuating element when received in the actuating opening moving the sealing element from the sealing position to the open position, said actuating element being arranged to at least one of: project into the container; project outward of the container; or to be movable; and to project outward of the container;

a catch device comprising a catch element arranged to move between a ready position and a catch position, wherein in the catch position, the catch element is arranged to hold the sealing element in the sealing position, and wherein in the ready position, the catch element enables the movement of the sealing element between said sealing position and said open position, a closing device arranged to displace the catch device from the catch position to the ready position, the catch device and the sealing element being coupled so that movement of the sealing element out of the sealing position into the open position displaces the catch device out of the ready position into the catch position, and wherein the container housing comprises a swivelling housing member which is arranged so that in an open position access to coins or documents of value through a housing opening in the container is enabled, and in a closing position the housing opening is closed to prevent access to the coins or documents of value; said swivelling housing member being lockable in the closing position by the closing device.

* * * * *